US005165259A

United States Patent [19]

Negri et al.

[11] Patent Number: 5,165,259

[45] Date of Patent: Nov. 24, 1992

[54] METHOD AND DEVICE FOR NEEDLE-BY NEEDLE SELECTION IN A CIRCULAR KNITTING MACHINE BY MEANS OF ELASTIC SELECTORS

[75] Inventors: Ettore Negri; Paolo Brandani; Paolo Salucci, all of Florence, Italy

[73] Assignee: Savio S.p.A., Pordenone, Italy

[21] Appl. No.: 635,932

[22] Filed: Dec. 28, 1990

[30] Foreign Application Priority Data

Jan. 12, 1990 [IT] Italy ..... 19060 A/90

[51] Int. Cl.[5] ..... D04B 15/78

[52] U.S. Cl. ..... 66/219; 66/216; 66/233

[58] Field of Search ..... 66/216, 218, 219, 221, 66/230, 233

[56] References Cited

U.S. PATENT DOCUMENTS 4,196,599 4/1980 Guell .
4,570,463 2/1986 Otto ..... 66/221
4,989,424 2/1991 Furia ..... 66/219

FOREIGN PATENT DOCUMENTS 2115332 10/1972 Fed. Rep. of Germany ..... 66/219
2305427 8/1974 Fed. Rep. of Germany ..... 66/219
2445291 4/1976 Fed. Rep. of Germany ..... 66/219
3537679 4/1987 Fed. Rep. of Germany .
2252431 11/1974 France .
2112822 7/1983 United Kingdom ..... 66/219

*Primary Examiner*—Werner H. Schroeder
*Assistant Examiner*—John J. Calvert
*Attorney, Agent, or Firm*—Robert D. Schaffer

[57] ABSTRACT

A circular knitting machine in which the inactivation or activation of a vertical jack below each needle is determined by a flexible fork located radially of the cylinder within a ring structure completely surrounding the machine cylinder and rigid therewith. A number of forks and radial grooves equal to the number of needles is provided, said forks being able to flex within said grooves and being selected by a magnetic force.

9 Claims, 3 Drawing Sheets

METHOD AND DEVICE FOR NEEDLE-BY NEEDLE SELECTION IN A CIRCULAR KNITTING MACHINE BY MEANS OF ELASTIC SELECTORS

FIELD OF THE INVENTION

This invention relates to circular knitting machines and in particular to the selection of needles in such machines for the purpose of producing patterned or diapered knitwork. A device and method are disclosed for selecting those needles which are to pick up the yarn from the feeds to form hosiery articles.

BACKGROUND OF THE INVENTION

Circular knitting machines are known to one or more needle cylinders which, as shown in FIG. 1, comprise tricks in their outer cylindrical surface. The tricks represent the guides for the needles which during their travel form the stitch loops in cooperation with the sinkers.

The number of tricks is equal to the number of needles which slide reciprocatingly within the tricks. Generally, in machines for producing women's stockings the number of tricks and needles is between 200 and 400 per cylinder. The needles reciprocate between a maximum position and a minimum position into which they are moved by suitable cams acting on the needle and the jack butts.

The cylinder is rotated as are the needles which during their reciprocating movement are fed with yarn in an angularly fixed position when in their highest point of travel. To produce hosiery articles generally only part of the available needles are used at the same time and in the same manner, except for the plain knitwork parts, for which all the needles are operated between their maximum and minimum level. In this mode of operation all of the needles are fed with yarn at each knitting course, and all are moved in the same manner.

When the machine is not producing plain knitwork, in order to produce other types of knitwork (such as mesh or patterned knitwork), some needles are required to produce stitch loops while others have to be raised to an intermediate level to take up yarn without clearing the previous stitch. This allows the formation of a tuck stitch, or have to be raised with a certain delay so that they do not pick up the yarn fed into a certain angular position and therefore do not form new loops. In other words a needle selection has to be made. This means that for each feed it has to be determined which and how many of needles must undergo a certain travel and which and how many other needles must undergo a certain different travel or no travle at all.

This selection is made by the jacks which slide in the same tricks as the needles lying above them, to move the needles to a higher level in order to seize the yarn.

The needles are driven reciprocatingly by fixed cams and counter-cams, which cause them to descend to form the stitch loops.

When the jacks have moved the needle into its working position they withdraw from the needle butt and return downwards.

If the needle, after completing its task of seizing the yarn and forming the stitch loop and therefore being at its minimum level, is not required to pick up a further yarn from another feed, it remains at this level because its control jack remains in its lower rest position.

The jack has a special shape (e.g. slightly curved or bowed) which corresponds to a precise function.

This curvature keeps the jack lightly forced towards the inside of the trick. This ensures the accurate positioning and lack of vibration of the jack by keeping it properly forced against to the trick walls, by requiring the application of a certain force to move it either axially or radially.

The shank of the jack comprises in its middle part an upper guide butt, which comes into engagement with its own control cam for urging the jack downwards when it has completed its task of pushing the needle.

Proceeding downwards along the jack shank there is an intermediate butt which comes into engagement with the lifting cam which raises the jack together with its overlying needle to seize the yarn.

The lowering cam and raising cam are obviously offset angularly and operate at different times on each jack. The foot of the jack comprises the lower guide butt. The lower said butt 8 is known to cooperate with other radial fixed cams which position the butt radially by urging the jack outwards so that its intermediate butt engages the raising cam, which moves the jack vertically upwards.

All the jacks are urged outwards by the radial cams so that their intermediate butt is engaged by the raising cam. The jacks are then raised to urge their needle into its operating position.

This rocking of the jack between its inner and outer position occurs by virtue of its rotation about a pivotal center in its upper part.

The purpose of the selection mechanism is to exclude the jacks which control those needles which, in forming the particular stitch, are not required to be raised.

A known mechanism for selecting or inactivating the needles consists of a plurality of levers or slides which come into contact with a plurality selection of butts on the lower part of the jack, in an intermediate position between the upper butt and the intermediate butt and which urge the jack back into the trick to prevent it from making contact with the raising cam.

The traditional selection procedure therefore consists of bringing a certain number of slides or levers into contact with a certain number of jacks via the selection butts located at the same height, by radially moving only some of the slides towards the outer surface of the cylinder. If a jack is to be left engaged when one or more of the slides have approached the needle cylinder, the selection butts corresponding to the height of those levers are removed from the jack. The number of levers or slides available for selection control is generally equal to the number of available selection butts.

The known selection procedures generally consist of producing contact between the non-removed selection butts of the jacks and the inactivating members, whether levers or slides, by rotating said inactivating members into a position of approach to the cylinder.

Obviously, those inactivating members which are not required to inactivate the jacks and whose butts are in a position corresponding to them are kept in the retracted position at the moment in which they would have made contact.

The devices which operate in accordance with this procedure include those of GB patent Application 2,147,015 A of Bentley Eng. Co. and Italian patents 1,183,228 and 1,186,475 of Officine Savio S.p.A. Needle selection by mechanical devices places very restrictive limits on the machine speed and the possible sequence combinations of needles in their raised position and needles in their lowered position.

The most recently proposed solutions are based on electromagnetic selection of the jacks via a single selection butt, using fixed electromagnetic selection members. Patent publications such as European patent application 219029 in the name of Lonati S.p.A., GB patent application 2,008,157 in the name of Shima Center Co. Ltd, GB patent 1,436,607 in the name of Precision Fukuhara Works Co. Ltd. and French patent 1,564,603 in the name of Mayer & Cie disclose selector devices which consist of a pack of electromagnetically operated selectors positioned at a point preceding each feed.

In GB patent application 2,043,712 in the name of Dainippon and others, the electromagnetic selector device is provided needle by needle, but the technical solutions involved are very complicated, especially for machines of high rotational speed.

These needle selection devices are fixed and operate on the jacks which raise the needles into activation when said jacks, during their rotation together with the cylinder, appear in front of the fixed selection station which precedes each machine feed station.

The time available for setting, initiating and completing the selection is very small, being of the order of a few thousandths of a second. The time is determined by the small angular sector within which the rotating jacks face the selection member, which must be immediately ready to select those needle jacks which at that moment are presented to them.

Most recently, the solution to the problem has turned towards mobile selection devices rotating together with the cylinder, so that the time available for selection is not limited to the moment in which the jacks appear before the stationary selection device. In this manner each jack is constantly presented to its selection member, so that the selection can take place within a wide angle of the cylinder rotation. In this manner the selection setting time is not so drastically small and the selection can be effected reliably and safely.

In U.S. patent application Ser. No. 461,383, needle selection is effected by controlling the radial position of the jacks by means of other corresponding horizontal jacks which slide radially. These horizontal jacks are selected by electromagnetic devices, by assuming a position withdrawn from the cylinder to thus allow the corresponding needle to operate, or a position close to the cylinder to thus inactivate the needle.

SUMMARY OF THE INVENTION

The present invention is directed to a device for selecting needles in a circular knitting machine comprising:

(A) a needle cylinder having a plurality of tricks for slidably retaining therein a like number of needles and jacks;

(B) said jacks comprising a flexible lower end including a butt and a foot;

(C) cam rings adapted to move the jacks from an active to an inactive position;

(D) a ring structure operatively connected to and surrounding the needle cylinder and comprising:

(1) a plurality of radially extending grooves, (2) a deformable fork element mounted within each of said grooves and comprising:

(a) an end piece adapted to engage the foot of the jack thereby deactivating the needle, (b) a pair of prongs, including a lower prong having a pointed portion adapted to rest in the radial groove, an upper prong having one or more surfaces for engaging a needle selection means, and a recess for engaging a pin positioned within the groove, and an end butt adapted to engage the foot of the jack, (3) needle selection means adapted to exert a discontinuous force on the fork elements whereby when the force is applied, the fork element moves from a first position wherein the end butt does not engage the foot of the jack thereby allowing the needle to be activated, to a second position wherein the end butt engages the foot of the jack thereby deactivating the needle.

BRIEF DESCRIPTION OF THE DRAWINGS

The following drawings are illustrative of embodiments of the invention and are not intended to limit the invention as encompassed by the claims forming part of the application.

DETAILED DESCRIPTION OF THE INVENTION

Figure 1A:
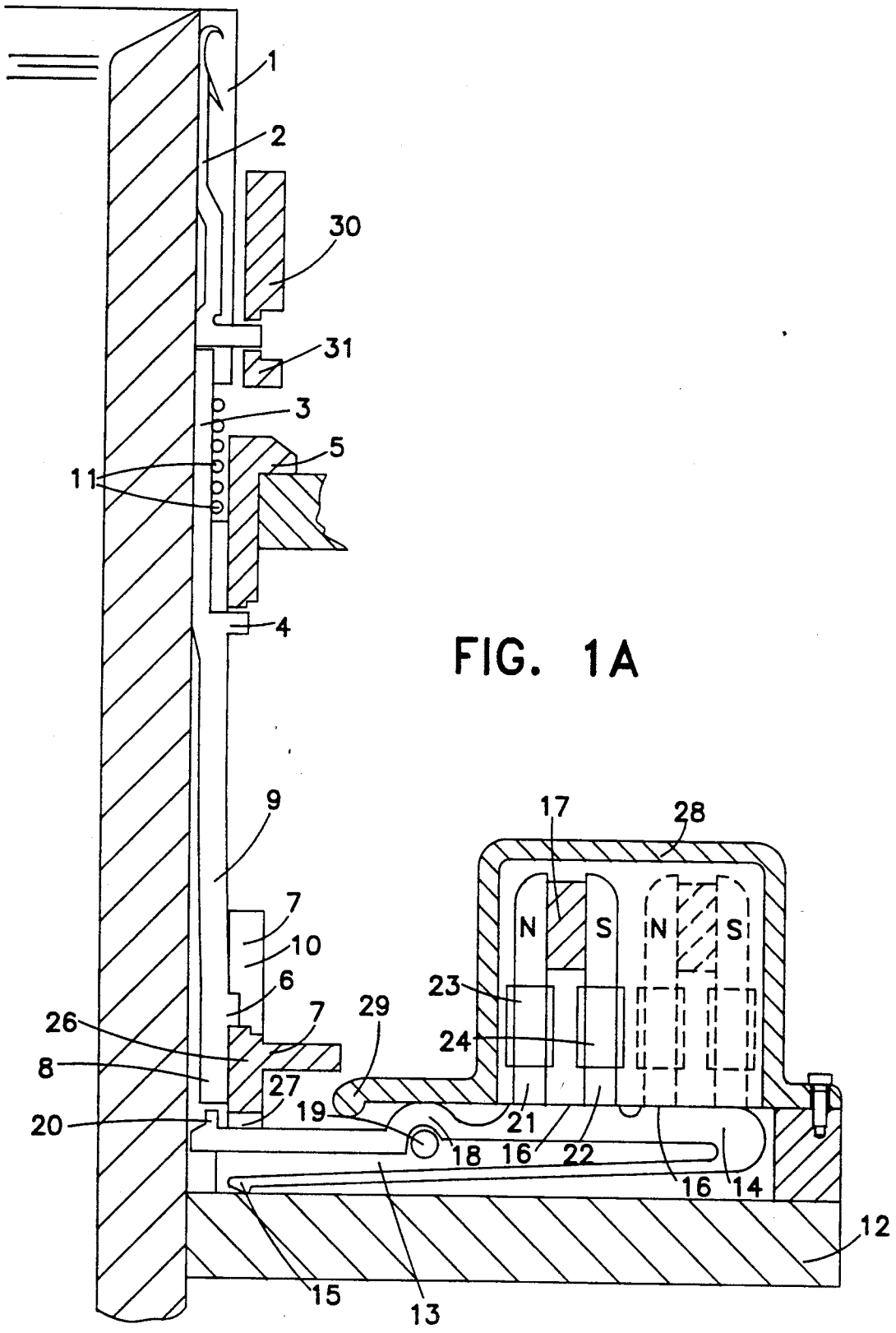
FIG. 1A is a cross-sectional view of one embodiment of the invention showing the end element in the lowered state.
Figure 1B:
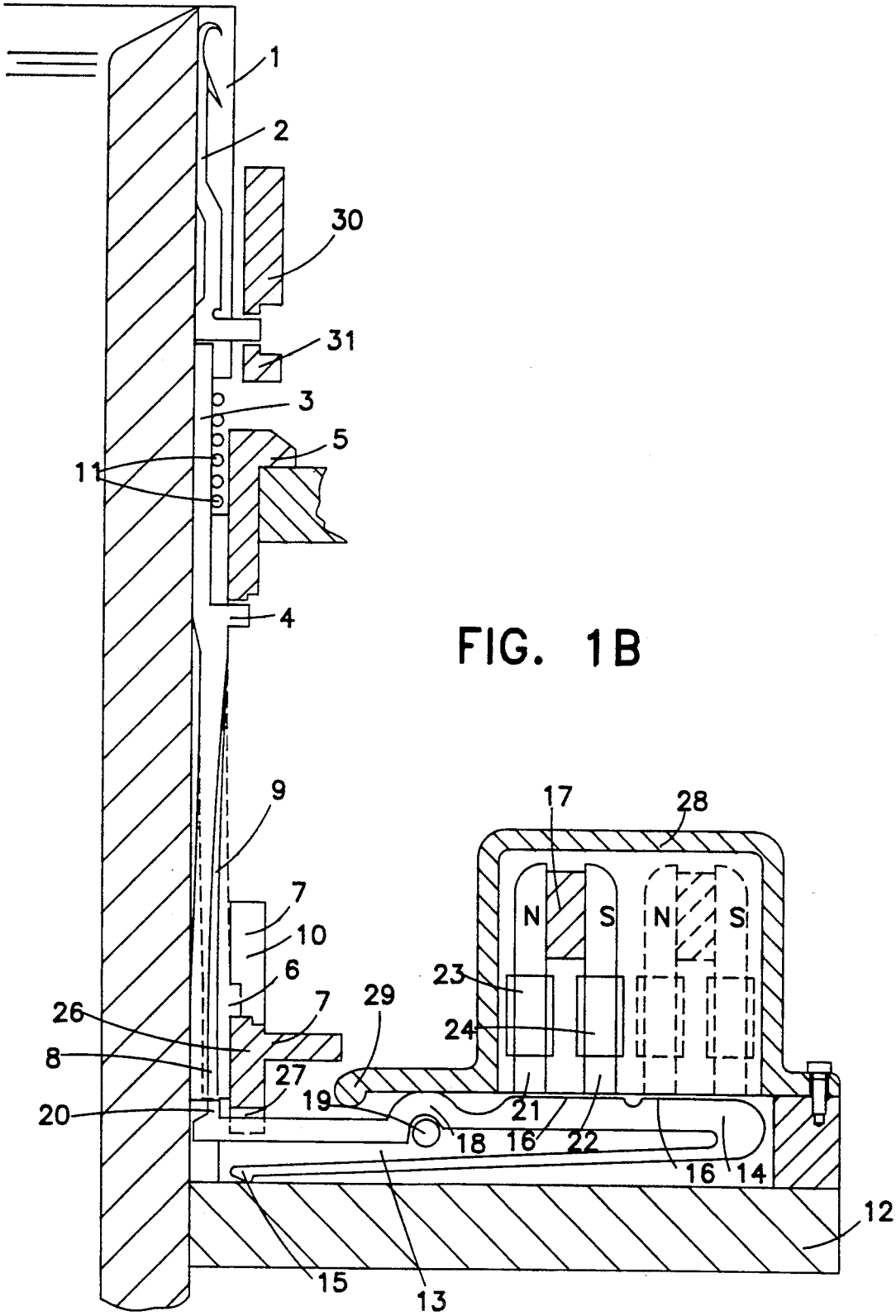
FIG. 1B is a cross-sectional view similar to FIG. 1A showing the end element in the raised state.

Referring to FIGS. 1A and 1B, the lower part of the jack 3 has a shape which is very different from the conventional shaped jack. The lower part 9 is narrower so that it is flexible in the plane of the figure between a flexed position (FIG. 1A), in which it has been urged into the trick 1 so that its butt 6 does not engage the raising contour 10 of the cam 7 and thereby remains lowered, and a non-flexed position (FIG. 1B) in which its butt 6 engages the raising contour 10 so that the jack is consequently raised. The jack 3 is bowed in its upper part above the butt 4; in contrast to the commonly used jacks, the jack 3 moves its lower part by bending, rather than by rotating, by rocking without substantial deformation about a bearing point in its upper part, as is usually the case with circular knitting machines using conventional jacks.

The jacks 3 are kept in position by one or more circular springs 11 surrounding the upper part of the jacks 3 and kept in position by one or more circumferential grooves in the cylinder, so that the springs lie within the outer surface of the needle cylinder. The springs 11 must be sufficiently strong to oppose the forces which flex the jack shank 9, so that the flexing forces acting on the foot 8 effect said flexure without causing the upper end of the jack to leave the trick 1.

Alternatively, these forces can be opposed by allowing the upper shank of the jack 3 to rest against the cam ring 5.

In contrast to known circular knitting machines there is no need for radial cams urging the jack foot 8 outwards, because the jack 3 urges its lower part outwards by virtue of its inherent elastic force.

A ring structure 12 embraces the entire needle cylinder and rotates at the same angular speed as the cylinder.

The ring structure 12 can derive its motion from the cylinder and move rigidly with it, or derive its motion from other parts of the circular knitting machine.

In positions corresponding with the axial tricks in the needle cylinder, the upper part of the ring structure 12 is provided with a number of radial grooves or slots 13 equal to the number of needles and jacks 3 of the circular knitting machine.

In the radial grooves 13 there are located elastic fork elements 14 which can deform by virtue of their two constituent prongs approaching each other, to become elastically loaded. Each fork element 14 is provided on its lower, preferably thinner prong with a pointed portion 15 which rests in the lower recess of the groove 13. On its upper more rigid prong there are provided, from right to left, one or more upper surfaces 16 facing, and coherent in shape with, the pole pieces of magnets 17 described in detail hereinafter, a circular recess 18 by which the fork 14 rests on a cylindrical pin 19, and an end butt 20 representing the element which acts on the jack foot 8.

In the embodiment shown in FIG. 1A, the forks 14 are selected by electromagnetic devices consisting of a permanent magnet 17 having a north pole piece 21 and south pole piece 22 facing the surface 16 in order to retain the fork 14 with its end element 20 in its low position such as not to interfere with the foot 8 of the jack 3.

About the pole pieces 21 and 22 there are electromagnetic coils 23 and 24 which, when energized by passing a direct current through them, exert a counter-action against the permanent magnets 21 and 22 to nullify their attraction towards the fork 14. This arrangement represents a preferred embodiment which utilizes a small amount of energy for selection purposes and limits the heat developed by the machine. However other equivalent electromagnetic selection arrangements are possible, such as the use as the attraction member for the fork element 14 of an electromagnet formed from a ferromagnetic core with a surrounding electrically conducting winding. The electromagnet, when traversed by electric current, attracts the face 16 of the fork and retains it. In this case it is the energization of the coil which retains the fork whereas the opposite applies to the previously described embodiment, namely the energization of the winding nullifies the attraction of the permanent magnet.

The raising cam 7 also performs other functions. Its inner face 26 engages all the butts 6 of the inactivated jacks 3 which pass in their low position, thereby retaining them within the trick 1, and in addition the cam is provided with an axial projection 27 which urges the faces 16 of all the fork elements 14 into proximity with the pole pieces of the magnets 17. This takes place within a determined angular sector before electromagnetic selection of the jacks, so that the required attraction force of attraction becomes very small. If the electromagnetic selection devices encounter problems from a lack of available circumferential space, a possible embodiment of the invention includes arranging the permanent magnets 17 with their opposing coils on two or more circumferences, and staggering the adjacent magnets.

The embodiment of FIGS. 1A and 1B shows an arrangement on two circumferences, one shown with full lines and the other with dashed lines. In this case the even selectors are on one circumference and the odd selectors on the other, so that each electromagnetic selector has an available circumferential space corresponding to two pitches of the radial groove 13.

The electromagnetic devices are contained in a casing 28 fixed to the ring structure 12. At its right hand end it is fixed with screws or other equivalent fixing means, whereas at its left hand end it rests on the upper part of the radially grooved surface and is provided with a rounded edge 29 which acts as an upper travel stop element for the upper prong of the fork 14.

Figures 2A, 2B:
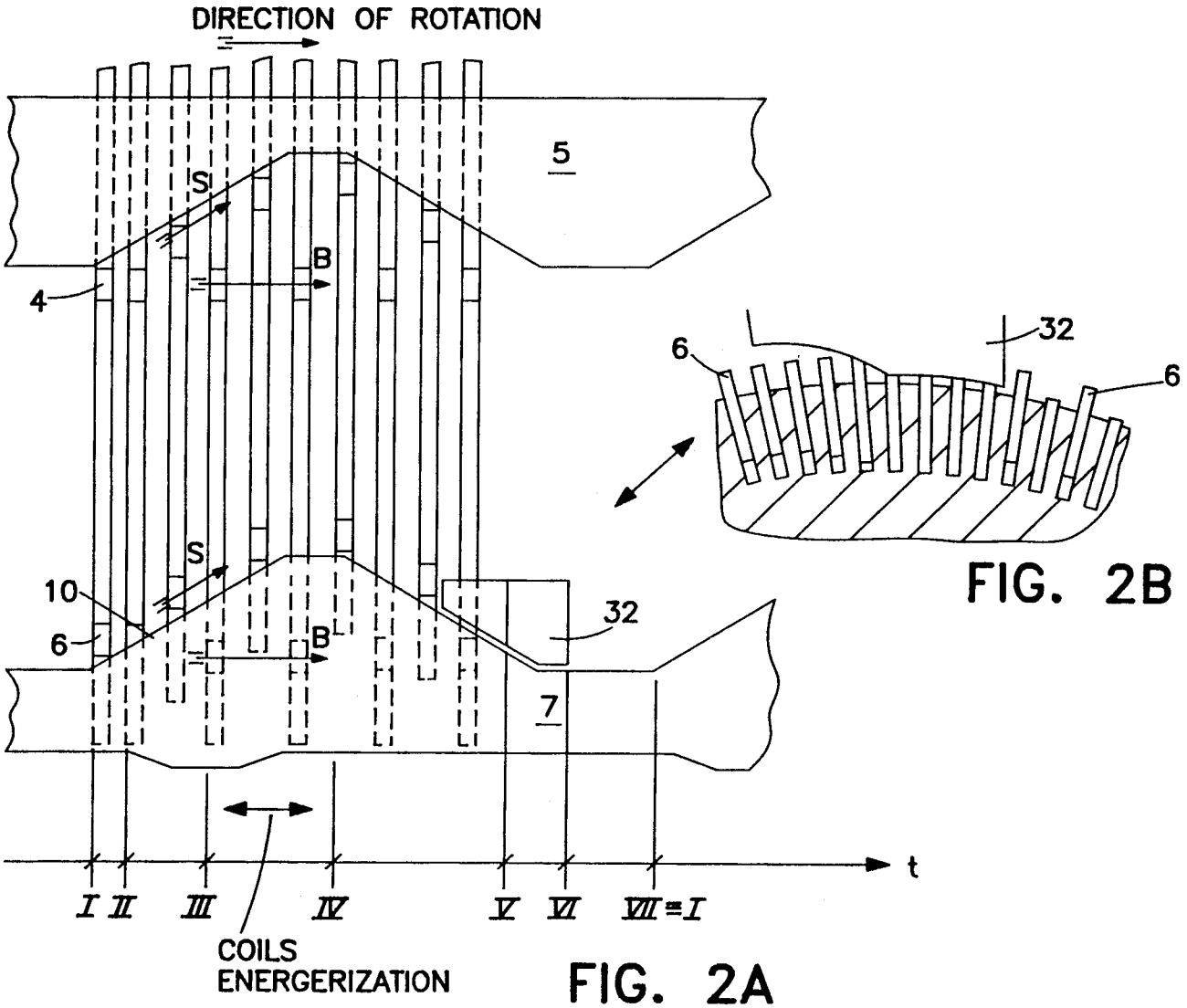
FIG. 2A is a graph showing the needle selection process through 90° rotation.
FIG. 2B is an enlarged view of the radial cam shown in FIG. 2A and its intraction with the butts.

FIGS. 2A and 2B shows the radial and circumferential path of the jacks as they are selected by the device of the invention and raised, lowered and flexed by the fixed cams. The fixed cams are positioned about the needle cylinder which rotates, dragging with it the jacks and the selection device.

The elastic jack 3, when not flexed, projects at its upper and lower butts from the needle cylinder surface so that these butts engage with the cams which are presented to them during rotation. The arrangement shown in FIGS. 2A and 2B relates to needle selection through a 90° angular sector, with the direction of rotation from left to right.

By way of example it shows the needles selected alternately, with one raised and the next left inactivated. FIGS. 2A and 2B also shows the angular positions of the axial and radial cams which select the needles.

a) The path of an operationally selected jack, which rises on the contour 10:

The jack 3 reaches time or angular position I with the element 20 of the fork low because its part 16 is retained by the permanent magnet 17 adhering to its pole pieces 21 and 22, by overcoming the elastic force of the fork. The foot 8 of the jack 3 is therefore free and projects from the cylinder by its butt 6. Its butt 6 engages the contour 10 of the cam 7 and rises, thereby activating its own needle. The needle 2 is then moved by its own cams 30 and 31 independently of the jack 3.

The jack 3 has now completed its task of activating its needle and can now return downwards. Proceeding along its rightward path, the upper guide butt 4 of the jack encounters the contour of the lowering cam 5, which lowers it and returns it to its previous level.

During its lowering the jack 3 encounters with its lower butt 6 a radial cam 32 which flexes the lower part 9 of the jack so that it penetrates into the trick until its foot 8 has passed beyond the element 20 of the corresponding fork. The jack 3 thereby rests radially against this the element 20 when it is raised, thereby inactivating the jack. The fork corresponding to that jack, which at time I was low is retained by the permanent magnet 17. If the jack at the next feed passes low to leave its needle inactivated, and the coils 23 and 24 are energized during the phase between positions III and IV by passing electric current through them and nullifying the attraction force of the magnet 17. In this case the elastic force of the fork 14 predominates to insert its element 20 against the foot 8 of the jack, thus preventing its butt 6 from engaging the contour 10 of the raising cam 7 and moving outwards during the phase between VI and VII. If this does not happen, at the end of the contour of the radial cam 32, the jack 3 returns its lower part 9 outwards by its elastic force during the phase between VI and VII, and can rise on the cam 7 at the next feed.

b) Path of a jack unselected for operation and therefore not rising on the contour 10:

The jack 3 reaches I retained within the trick 1 by the element 20 of the fork 14.

All the forks are then lowered at time or angular position II and moved by the cam 27 into contact with its part 16 with the pole pieces 21 and 22 and, as the coils 23 and 24 are not energized the forks, are retained in this position if at the next feed their jack has to operate and move its needle upwards.

In the opposite case, during the phase between III and IV the coils 23 and 24, relative to the needles to be kept at rest, are energized to thus release the fork 14. Its element 20 can then be inserted to keep the jack butt 6 out of range of the contour 10 of the cam 7. The jack remaining in its lowered position and thereby not activating its needle at the next feed.

The needle selection procedure takes place in accordance with the following stages:

at time I the jacks are presented to the raising cam 7, some of which have been selected to be raised and have their butt 6 projecting from the needle cylinder trick 1 to engage with the contour 10, which raises them along the path S; the other jacks which have not been selected to be raised remain low and follow the path B. After time I the jacks which have not engaged the contour 10 of the cam 7 and thus follow the path B cannot move outwards because the outer face of their butt 6 would encounter the inner face 26 of the cam 7, preventing them from emerging;

at time II all the forks 14 encounter the cam 27, which raises their part 16 into proximity with the pole pieces 21 and 22, while lowering the elements 20 of the fork 14;

at time III the opposing coils 23 and 24 corresponding to those forks which are not retained in order that their elements 20 can oppose the outward elastic return of the jack foot 8 are energized, whereas the other coils are left unenergized to enable the corresponding magnets 17 to continue to retain their forks;

at time IV coil energization ceases; the feet of those jacks which pass low are retained within the trick firstly by the face 26 and then by the cam 32 until time VI. Shortly after time IV those jacks following the path S encounter the lowering cam 5 with their upper butt 4, and are caused to return downwards. During the final stage of the descent the outer face of the butt 6 encounters the radial cam 32 which compels all the jacks following the path S to flex their portion 9 so that their foot slides in the most inner recess of the trick 1. FIG. 2B also shows an enlarged detailed view in the horizontal plane of the cam 32 which intercepts the butts 6;

at time V the presence of the cam 32 results in the insertion of the foot of the descending jack into the space delimited by the radial cam 26 and possibly by the element 20 which has been raised and retained by the corresponding magnet 17. In FIG. 2B the element 20 is shown in its lowered position with the magnet 17 retaining the face 16 of the fork, the element 20 thus being in a position of non-interference with the foot 8;

at time VI all the jacks have their foot 8 in its inner position and their portion 9 in the flexed configuration. On termination of the contour of the cam 32 those jacks which are not prevented by the element 20 return outwards by their own elastic force. These jacks are able to engage with the contour 10 to follow the path S, while those which are prevented by the element 20 remain in their inner position so that their butt 6 does not engage the contour 10 at time VII, which corresponds to time I, with the result that they follow the path B.

The rotary assembly comprising the selection unit is also provided with a system for transmitting both electrical power and the selection control signals. Said transmission system is not shown in the figure drawings for simplicity. Electrical power can be transmitted in a totally conventional manner by sliding contacts using contact tracks along which brushes of conducting material slide, and of which the former rotates with the selection unit and the latter remain stationary or vice versa.

The control signals can be transmitted either by sliding contacts or by contactless remote transmission. The rotary assembly houses the electronic components and the printed circuits for decoding the selection control signals and for the energization of the coils 23 and 24 which oppose the magnets 17. The copending U.S. patent application Ser. No. 07/619,750 of the present applicant describes devices and methods for the contactless remote transmission of needle selection commands in a circular knitting machine by magnetic pulses in binary code which are transmitted by a static winding surrounding the rotary assembly to a sensor which is rigid with the assembly itself and runs along the winding.

The device according to the invention has considerable advantages over the devices of the known art, of which at least the following should be mentioned.

The device allows needle-by-needle selection at high speeds of 1000 r.p.m. and more on 400-needle multi-feed machines. It is of limited overall height and enables the cylinder and jack height to be reduced.

The vertical jacks do not rock within the tricks under the control of radial deviation cams, which are no longer necessary, nor are the return springs for the horizontal jack described in U.S. patent application Ser. No. 461,383. The mechanical actuation system for the selection is much simpler.

The opposition coils are required to be energized only for a short time and only for those needles to be inactivated. The momentum of the reciprocating masses and thus the energy required in the mechanical selection control are therefore reduced.

The electromagnetic actuation requires little energy and results in very short response times as no member has to undergo movement. The fact that the electromagnetic selector is always in a position corresponding with its jack means that the selection can be made with total reliability, rather than in the very short time available in systems of the known art in which the member to be selected rotates and the selector is fixed, the selection having to be initiated and executed within the very small space and time during which the two members correspond.

We claim:

1. A device for selecting needles in a circular knitting machine comprising:

(A) a needle cylinder having a plurality of tricks for slidably retaining therein a like number of needles and jacks;

(B) said jacks comprising a flexible lower end including a butt and a foot;

(C) cam rings for moving the jacks from an active to an inactive position;

(D) a ring structure operatively connected to and surrounding the needle cylinder and comprising:

(1) a plurality of radially extending grooves, (2) a deformable fork element mounted within each of said grooves and comprising:

(a) an end piece for engaging the foot of the jack thereby deactivating the needle, (b) a pair of prongs, including a lower prong having a pointed portion resting in the radial groove, an upper prong having one or more surfaces for engaging a needle selection means, and a recess for engaging a pin positioned within the groove, and an end butt for engaging the foot of the jack, (3) needle selection means for exerting a discontinuous force on the fork elements whereby when the force is applied, the fork element moves from a first position wherein the end butt does not engage the foot of the jack thereby allowing the needle to be activated, to a second position wherein the end butt engages the foot of the jack thereby deactivating the needle.

2. The device of claim 1 wherein the needle selection means comprises permanent magnets operatively connected to a coil, said coil adapted to nullify the force provided by the permanent magnets against the fork elements.

3. The device of claim 1 wherein the needle selection means comprises electromagnets comprising a ferromagnetic core and a conductive winding, wherein when an electric current is supplied to the winding the fork element is retained against the electromagnet.

4. The device of claim 1 wherein the cam rings comprise a first cam for raising the jacks selected to be raised into contact with the needle and a second cam for lowering the raised jacks out of contact with the needle, said device further comprising a third cam engaging the butt of the jack to thereby move the butt into the trick within a space defined by the first cam.

5. The device of claim 4 further comprising retaining means for retaining the jacks that are not to be raised within the trick, said retaining means comprising a jack retaining face on the first and third cams.

6. The device of claim 4 further comprising a fourth cam operatively connected to the first cam for urging the fork elements into operative engagement with the needle selection means.

7. The device of claim 6 wherein the needle selection means comprises permanent magnets operatively connected to a coil, said coil adapted to nullify the force provided by the permanent magnets against the fork elements.

8. The device of claim 6 wherein the needle selection means comprises electromagnets comprising a ferromagnetic core and a conductive winding, wherein when an electric current is supplied to the winding the fork element is retained against the electromagnet.

9. The device of claim 1 further comprising means for concurrently rotating the needle cylinder and the ring structure while retaining the cam rings at rest.

* * * * *